US008621820B2

(12) United States Patent
Tatrault

(10) Patent No.: US 8,621,820 B2
(45) Date of Patent: Jan. 7, 2014

(54) WALL LEVELING DEVICE AND METHOD FOR MANUFACTURING AND USING THE SAME

(76) Inventor: Dean A. Tatrault, Commack, NY (US)

( * ) Notice: Subject to any disclaimer, the term of this patent is extended or adjusted under 35 U.S.C. 154(b) by 0 days.

(21) Appl. No.: 13/360,165

(22) Filed: Jan. 27, 2012

(65) Prior Publication Data

US 2013/0192163 A1 Aug. 1, 2013

(51) Int. Cl.
*E04B 1/00* (2006.01)

(52) U.S. Cl.
USPC ..... 52/745.2; 52/712; 52/481.1

(58) Field of Classification Search
USPC ..... 52/846, 481.1, 287.1, 712, 92.2, 93.1, 52/58, 300, 301, 716.1
See application file for complete search history.

(56) References Cited

U.S. PATENT DOCUMENTS 3,255,561 A * 6/1966 Cable ..... 52/255
4,789,138 A 12/1988 Acton
4,890,426 A 1/1990 Hickman et al.
5,280,692 A 1/1994 Patey
5,772,185 A 6/1998 Pulsipher
5,822,942 A * 10/1998 Lucia, Jr. ..... 52/514
5,906,080 A * 5/1999 diGirolamo et al. ..... 52/243.1
6,176,053 B1 * 1/2001 St. Germain ..... 52/232
6,240,682 B1 * 6/2001 James et al. ..... 52/90.2
6,516,584 B1 2/2003 Rudd
6,523,315 B2 * 2/2003 Ford ..... 52/514
6,612,087 B2 * 9/2003 diGirolamo et al. ..... 52/712
6,938,387 B2 * 9/2005 Belanger ..... 52/645
7,832,162 B1 * 11/2010 Abdel-Rahman et al. ..... 52/272
7,836,639 B2 * 11/2010 Aramaki et al. ..... 52/27
8,056,293 B2 * 11/2011 Klein ..... 52/483.1
2005/0055952 A1 3/2005 McGonigal
2009/0211177 A1 * 8/2009 Grafton et al. ..... 52/93.1

* cited by examiner

*Primary Examiner* — Brian Glessner
*Assistant Examiner* — Beth Stephan
(74) *Attorney, Agent, or Firm* — F. Chau & Associates, LLC

(57) ABSTRACT

An adjustable stud adapter is configured to attach to a stud. The adjustable stud adapter includes a front surface, a side surface substantially perpendicular to the front surface, and a first positioning slot and a second positioning slot formed on the side surface. The first and second positioning slots have an elongated shape and are substantially parallel to each other.

9 Claims, 5 Drawing Sheets

WALL LEVELING DEVICE AND METHOD FOR MANUFACTURING AND USING THE SAME

BACKGROUND

1. Technical Field

The present disclosure relates to a wall leveling device, and more particularly, to an adjustable stud adapter and a method for manufacturing and using the same.

2. Discussion of Related Art

In construction, studs function as structural members, providing a stable frame to which walls and ceilings are attached. A plurality of studs spaced apart from each other form a planar surface for securely receiving a wall or a ceiling. Studs are frequently constructed of wood. Irregularities and imperfections in the wood used to form a stud may result in a change in shape of the stud. For example, irregularities and imperfections in a wood stud may result in the wood stud not being straight, and thus, not being coplanar with adjacent studs. When studs are not coplanar, an attached wall or ceiling may not be flat, level, or plumb.

BRIEF SUMMARY

According to an exemplary embodiment of the present disclosure, an adjustable stud adapter includes a front surface, a side surface, a first positioning slot, and a second positioning slot. The side surface is substantially perpendicular to the front surface. The first positioning slot and the second positioning slot are formed on the side surface, have an elongated shape, and are substantially parallel to each other. The adjustable stud adapter is configured to attach to a stud.

The adjustable stud adapter may have an L-shape, the front surface forming one leg of the L-shape, and the side surface forming the other leg of the L-shape.

According to an exemplary embodiment of the present disclosure, a method of leveling a surface includes slidably attaching an adjustable stud adapter to a stud via a first positioning slot and a second positioning slot disposed on a side surface of the adjustable stud adapter by partially driving a first fastener into the stud through the first positioning slot, and partially driving a second fastener into the stud through the second positioning slot, adjusting a plumbness of a front surface of the adjustable stud adapter by slidably adjusting an angle of the adjustable stud adapter relative to the stud, wherein the angle of the adjustable stud adapter is adjusted by sliding edges of the first positioning slot and the second positioning slot on the first fastener and on the second fastener, respectively, wherein the front surface is substantially perpendicular to the side surface, and securely attaching the adjustable stud adapter to the stud via the first positioning slot and the second positioning slot by further driving the first fastener into the stud through the first positioning slot, and further driving the second fastener into the stud through the second positioning slot.

According to an exemplary embodiment of the present disclosure, a method of leveling a surface includes inserting a first fastener through a first positioning slot disposed on a side surface of an adjustable stud adapter and inserting a second fastener through a second positioning slot disposed on the side surface of the adjustable stud adapter to slidably attach the adjustable stud adapter to a stud, wherein the first and second positioning slots have an elongated shape and are substantially parallel to each other, slidably adjusting a position of the adjustable stud adapter relative to the stud about the first fastener and about the second fastener to adjust a plumbness of a front surface of the adjustable stud adapter, wherein the front surface is substantially perpendicular to the side surface, and tightening the first and second fasteners to securely attach the adjustable stud adapter to the stud.

BRIEF DESCRIPTION OF THE SEVERAL VIEWS OF THE DRAWINGS

The above and other features of the present disclosure will become more apparent by describing in detail exemplary embodiments thereof with reference to the accompanying drawings, in which.

DETAILED DESCRIPTION

Exemplary embodiments of the present disclosure now will be described more fully hereinafter with reference to the accompanying drawings. This disclosure, may however, be embodied in many different forms and should not be construed as limited to the exemplary embodiments set forth herein.

Figure 1:
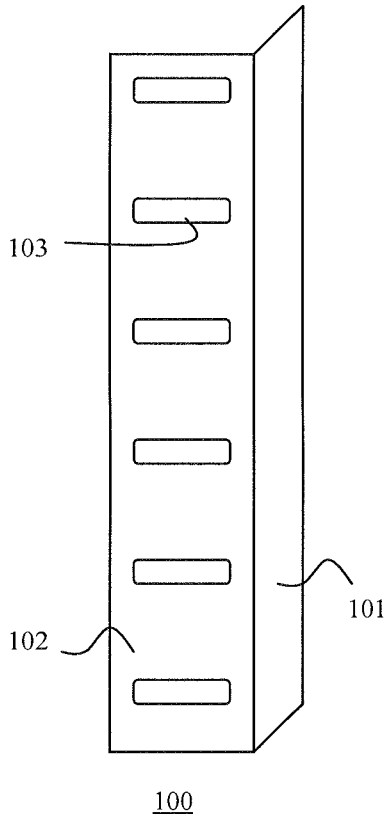
FIG. 1 shows an adjustable stud adapter, according to an exemplary embodiment of the present disclosure.

FIG. 1 shows an adjustable stud adapter, according to an exemplary embodiment.

The adjustable stud adapter 100 shown in FIG. 1 may be formed of, for example, steel or aluminum, however the adjustable stud adapter 100 is not limited thereto. The adjustable stud adapter 100 includes a front surface 101 and a side surface 102. The front surface 101 has a width of about 1.25 inches to about 1.5 inches, and the side surface 102 has a width of about 3 inches to about 3.5 inches, however the respective widths are not limited thereto. The gauge of the adjustable stud adapter 100 is about 0.020 to about 0.025, however the gauge is not limited thereto. For example, as will be understood by one of ordinary skill in the art, the gauge of the adjustable stud adapter 100 may be any gauge that is stiff enough to maintain the straightness of the adjustable stud adapter 100, but flexible enough to allow the adjustable stud adapter 100 to be cut into or screwed into.

The side surface 102 of the adjustable stud adapter 100 in FIG. 1 includes a plurality of positioning slots 103. The positioning slots 103 extend along the side surface 102 in a vertical direction, and are substantially parallel with each other. According to an embodiment, the positioning slots 103 are parallel with each other so as to facilitate angle adjustment of the adjustable stud adapter 100 with respect to a stud 200. Each of the positioning slots 103 has an elongated shape, and may have a length of about 2 inches to about 2.5 inches and a width of about 0.10 inches to about 0.20 inches, however the length and width of the positioning slots 103 are not limited thereto. According to an embodiment, the positioning slots 103 are spaced apart from each other at regular intervals in the vertical direction. In an exemplary embodiment, there may be a total of 10 positioning slots 103 and the positioning slots 103 may be spaced apart from each other at a distance of about 8 inches, however the number of slots 103 and the distance between the slots 103 are not limited thereto.

Figure 2A:
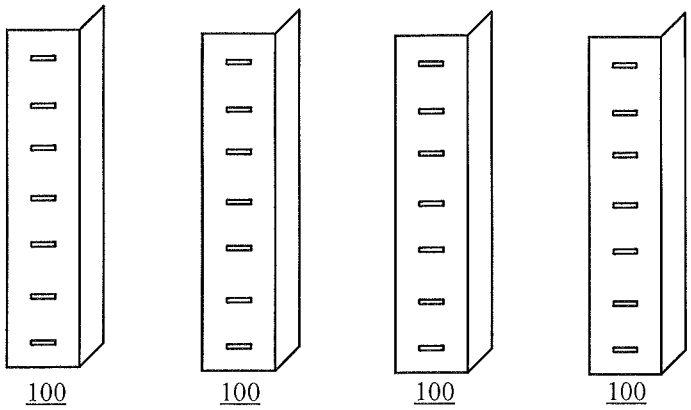
FIG. 2A shows a plurality of adjustable stud adapters, as disclosed with reference to FIG. 1.

FIG. 2A shows four adjustable stud adapters 100, as disclosed with reference to FIG. 1.

Figure 2B:
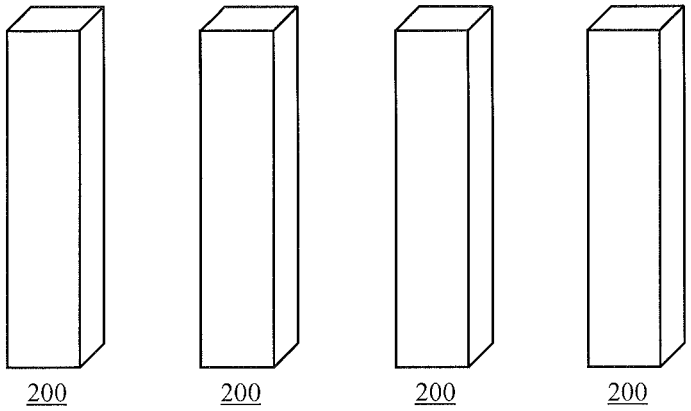
FIG. 2B shows a plurality of studs to which the adjustable stud adapters of FIG. 2A would be attached.

FIG. 2B shows four studs 200 to which the adjustable stud adapters 100 would be attached. The studs 200 are typical studs used in construction to form walls and ceilings. For example, the studs 200 may be wood studs such as, for example, standard 2×4 or 2×6 inch wood studs, however, as will be understood by one of ordinary skill in the art, the adjustable stud adapters 100 may be attached to a variety of types of studs.

Figure 2C:
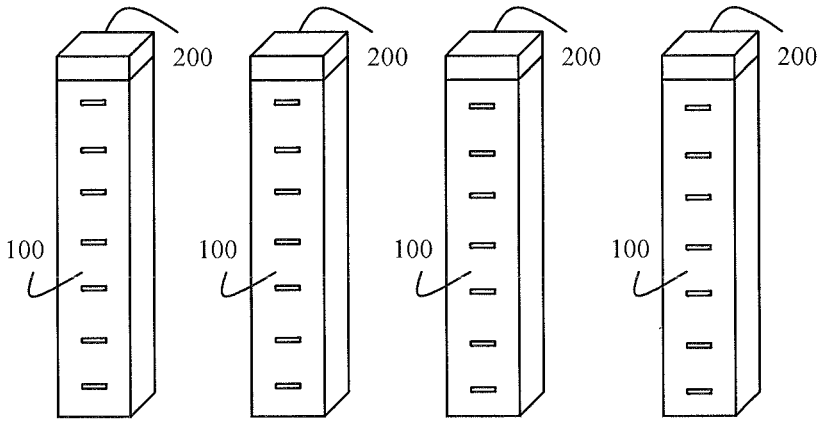
FIG. 2C shows the adjustable stud adapters of FIG. 2A attached to the studs of FIG. 2B.

FIG. 2C shows the adjustable stud adapters 100 attached to the studs 200.

Figure 2D:
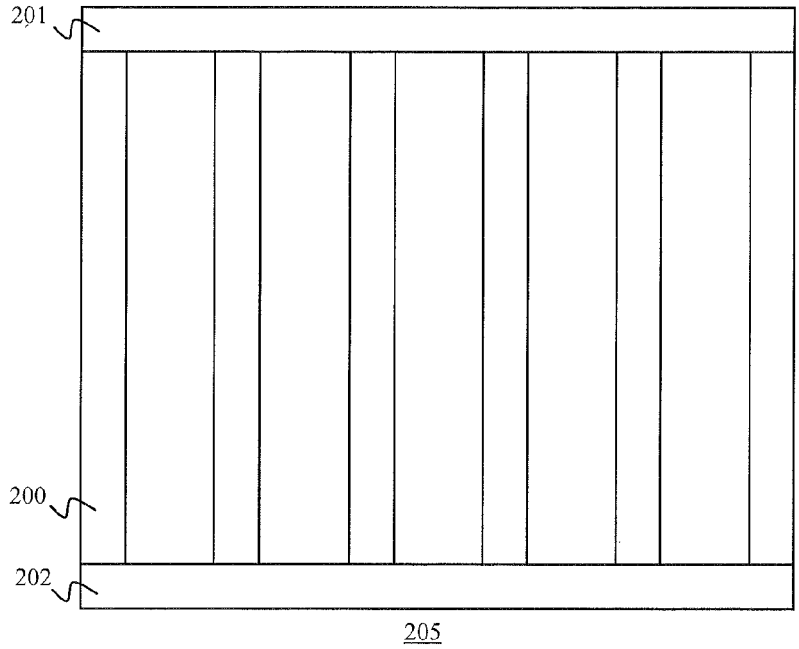
FIG. 2D shows a front view of a framed out wall constructed from the plurality of studs of FIG. 2B.
Figure 2E:
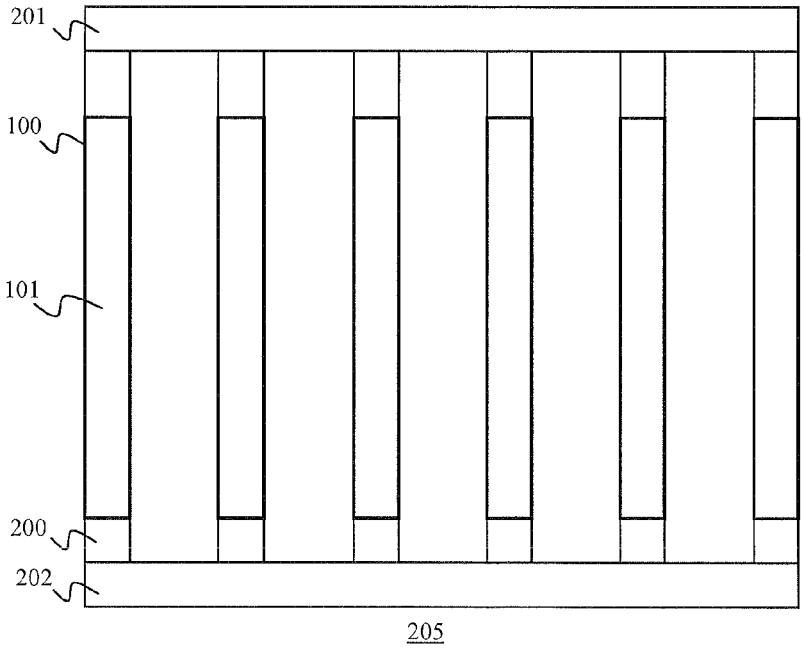
FIG. 2E shows a front view of the adjustable stud adapters of FIG. 2A attached to the framed out wall of FIG. 2D.

FIG. 2D shows a front view of a framed out wall 205 including a plurality of studs 200 attached to a top plate 201 and a bottom plate 202. FIG. 2E shows a front view of the adjustable stud adapters 100 attached to the plurality of studs 200 of the framed out wall 205.

Figure 3A:
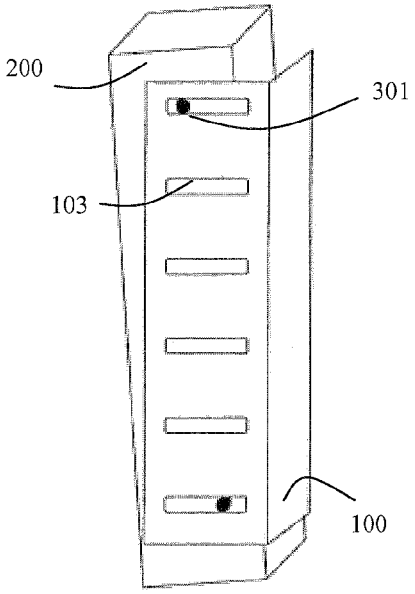
FIGS. 3A and 3B show adjustable stud adapters attached to uneven studs after the adjustable stud adapters have been adjusted to be plumb.
Figure 3B:
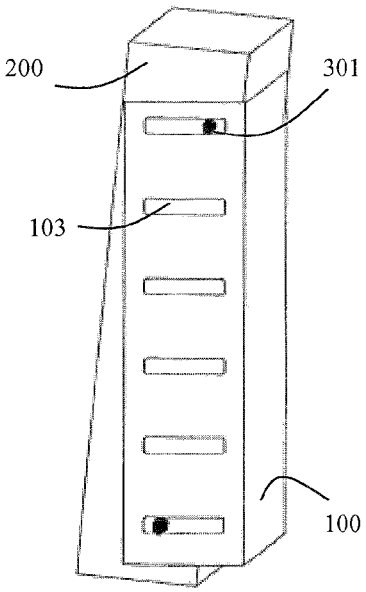

FIGS. 3A and 3B show adjustable stud adapters 100 attached to uneven studs 200 after the plumbness of the adjustable stud adapters 100 has been adjusted.

The studs 200 shown in FIG. 2C function as structural members during construction, and provide a stable frame to which a wall or ceiling may be attached. For example, a wall or ceiling constructed from sheetrock or paneling may be attached to the studs 200. If any of the studs 200 have irregularities or imperfections, such as, for example, warping or bowing, a change in the shape of the stud 200 may occur. For example, irregularities and imperfections in a stud 200 may result in the stud 200 not being straight, and thus, not being coplanar with adjacent studs 200. When studs 200 are not coplanar with each other, an attached wall or ceiling will not be plumb (e.g., flat, straight or level). According to an exemplary embodiment, an adjustable stud adapter 100 may be attached to a stud 200 that is not coplanar with adjacent studs 200. The adjustable stud adapter 100 is attached to the stud 200 such that the front surface 101 of the adjustable stud adapter 100 is coplanar with adjacent studs 200. As can be seen in FIGS. 3A and 3B, the angle of the adjustable stud adapter 100 with respect to the stud 200 is adjusted based on the irregularities of the stud 200 to make the adjustable stud adapter 100 plumb, and based on how the stud 200 sits in relation to other studs 200 on the same wall or ceiling. Thus, adjustable stud adapters 100 may be used to perform a method of leveling, plumbing, or flattening a wall.

The positioning slots 103 allow the position of the adjustable stud adapter 100 to be adjusted while the plumbness of the adjustable stud adapter 100 is being measured. That is, the positioning slots 103 allow for concurrent adjustment and measurement of the adjustable stud adapter 100. Plumbness refers to the straightness of the front surface 101 of the adjustable stud adapter 100.

According to an embodiment, installation of the adjustable stud adapter 100 may be described as including two phases. In a first phase, referred to herein as the adjustment phase, the adjustable stud adapter 100 is loosely secured to a stud 200 by placing at least one fastener 301 through at least one positioning slot 103 and into the stud 200. Since the positioning slots 103 are parallel with each other and are elongated, a plurality of fasteners 301 may be placed in a plurality of positioning slots 103 to better maintain the position of the adjustable stud adapter 100, while still allowing the plumbness of the adjustable stud adapter 100 to be adjusted. For example, a fastener 301 may be placed in the uppermost positioning slot 103 and the lowermost positioning slot 103 to maintain the position of the adjustable stud adapter 100 while adjusting the plumbness. The fastener 301 may be a nail or screw such as, for example, a metal dry wall screw, however the fastener 301 is not limited thereto. The size of the fastener 301 may vary, and should be chosen with respect to the size of the positioning slots 103. For example, the fastener 301 should be small enough relative to the positioning slot 103 such that the fastener 301 does not catch the adjustable stud adapter 100 during tightening, and thus, change the position of the adjustable stud adapter 100. In addition, the fastener 301 should not be too small relative to the positioning slot 103 such that the fastener 301 slips through the positioning slot 103 during tightening. In the adjustment phase, the fastener 301 is attached tight enough to maintain the position of the adjustable stud adapter 100 on the stud 200, but loose enough to allow the angle of the adjustable stud adapter 100 with to be adjusted with respect to the stud 200.

Once the plumbness of the adjustable stud adapter 100 has been adjusted and is satisfactory, the fastener 301 is tightened to securely attach the adjustable stud adapter 100 to the stud 200. For example, the fastener 301 inserted through the positioning slot 103 in the adjustable stud adapter 100 may be tightened to secure the adjustable stud adapter 100 to the stud 200 so that the adjustable stud adapter 100 does not move. Additional fasteners 301 in a plurality of positioning slots 103 may be used to stabilize the position of the adjustable stud adapter 100. This phase is referred to as the attachment phase.

The interior area of both the front surface 101 and the side surface 102 of the adjustable stud adapter 100 (e.g., the area of the front surface 101 and side surface 102 that makes contact with the stud 200) is substantially smooth, and does not have any rough edges or burrs. The smoothness of the interior areas allows the plumbness of the adjustable stud adapter 100 to be adjusted while the adjustable stud adapter 100 is loosely secured to the stud 200 during the attachment phase. For example, the smoothness of the interior areas allows the person installing the adjustable stud adapter 100 to slide portions of the adjustable stud adapter 100 towards and away from the stud 200 in order to adjust the plumbness. Rough edges or burrs present on the interior areas would hinder the installer's ability to slidably adjust the position of the adjustable stud adapter 100 when adjusting the plumbness. For example, referring to FIG. 3A, smooth interior areas of the adjustable stud adapter 100 allow an installer to slidably move the top portion of the adjustable stud adapter 100 away from the uneven stud 200 about a horizontal axis, and slidably move the bottom portion of the adjustable stud adapter 100 towards the uneven stud 200 about the horizontal axis when adjusting the plumbness of the adjustable stud adapter 100. Similarly, referring to FIG. 3B, smooth interior areas of the adjustable stud adapter 100 allow an installer to slidably move the top portion of the adjustable stud adapter 100 towards the uneven stud 200 about the horizontal axis, and slidably move the bottom portion of the adjustable stud adapter 100 away from the uneven stud 200 about the horizontal axis when adjusting the plumbness of the adjustable stud adapter 100.

Since the adjustable stud adapters 100 allow for concurrent adjustment and measurement, multiple adjustable stud adapters 100 may be simultaneously installed onto multiple studs 200, and the plumbness and/or flatness of the multiple adjustable stud adapters 100 may be simultaneously adjusted with respect to each other. That is, the design and functionality of the adjustable stud adapters 100 in the current disclosure allow for multiple adjustable stud adapters 100 to be put in place and adjusted concurrently. For example, multiple adjustable stud adapters 100 may be attached to multiple studs 200 such that they are tight enough to maintain the position of the adjustable stud adapters 100 on the studs 200, and loose enough to allow the plumbness of the adjustable stud adapters 100 to be adjusted. The ability to simultaneously adjust the plumbness of multiple adjustable stud adapters 100 is useful in situations where multiple studs 200 of the same wall or ceiling are not coplanar with adjacent studs 200. In this situation, it is likely that the multiple adjustable stud adapters 100 will have to be re-adjusted a number of times, since the plumbness of each adjustable stud adapter 100 depends on the plumbness of adjacent adjustable stud adapters 100. The ability to slidably adjust each adjustable stud adapter 100 before finally securing each adjustable stud adapter 100 to its corresponding stud 200 aids the installer in a situation where multiple studs 100 are not plumb and require the installation of an adjustable stud adapter 100.

As shown in FIG. 1, the adjustable stud adapter 100 includes two surfaces—a front surface 101 and a side surface 102. As a result of this design, the adjustable stud adapter 100 may be attached to a stud 200 without the installer being required to have access to the entire stud 200. For example, a stud 200 in the corner of a wall or in the corner of a ceiling (e.g., a corner stud) may not be straight, and may require an adjustable stud adapter 100 to make the corner stud coplanar with adjacent studs. Since the corner stud is located in a corner, the user does not have access to both sides of the corner stud. Rather, the user only has access to the front surface of the corner stud (e.g., the surface to which a wall or ceiling is to be attached) and one side surface of the corner stud. The installer does not have access to the side surface opposite the accessible side surface. In this situation, the side surface 102 of the adjustable stud adapter 100 may be attached to the accessible side surface of the corner stud, and the plumbness may be adjusted.

In addition to allowing for the installation of the adjustable stud adapter 100 on a corner stud, the design of the adjustable stud adapter 100 results in a cost-efficient manufacturing process. For example, since the adjustable stud adapter 100 includes only two surfaces (e.g. the front surface 101 and the side surface 102), a single sheet of material (e.g., steel or aluminum) only has to be bent once to form the two surfaces 101, 102 of the adjustable stud adapter 100. This results in a cost-efficient manufacturing process, since a minimal amount of material and a minimal amount of steps are required to form the adjustable stud adapter 100. The adjustable stud adapter 100 may be manufactured using, for example, a hot-dip galvanizing process, and the manufacturing process may utilize the same type of machinery used to produce steel studs. The positioning slots 103 may be made using, for example, a grinder or a metal cutting blade.

According to an embodiment, the adjustable stud adapter 100 includes a hemmed vertical joint for additional strength.

Figure 4:
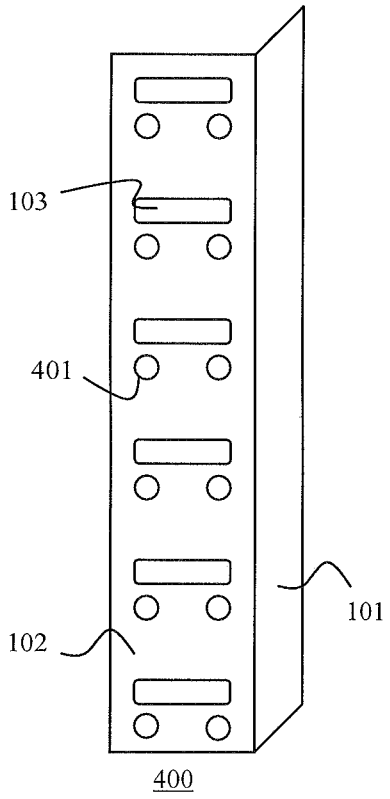
FIG. 4 shows an adjustable stud adapter, according to an exemplary embodiment of the present disclosure.

FIG. 4 shows an adjustable stud adapter, according to an exemplary embodiment.

The adjustable stud adapter 400 shown in FIG. 4 is substantially similar to the adjustable stud adapter 100 described with reference to FIG. 1, except that the adjustable stud adapter 400 also includes a plurality of securing holes 401. In an exemplary embodiment, the securing holes 401 may be located about 1 inch away from the positioning slots 103, however the location of the securing holes 401 is not limited thereto. The securing holes 401 are utilized during the attachment phase to further secure the adjustable stud adapter 400 to a stud 200. The securing holes 401 provide an extra level of stability when attaching the adjustable stud adapter 400 to a stud 200. For example, during the adjustment phase, the adjustable stud adapter 400 is loosely secured to a stud 200 by placing at least one fastener 301 through at least one positioning slot 103 and into the stud 200. The fastener 301 is attached in a manner that is tight enough to maintain the position of the adjustable stud adapter 400 on the stud 200, and loose enough to allow the plumbness of the adjustable stud adapter 100 to be adjusted. Once the plumbness of the adjustable stud adapter 400 has been adjusted and is satisfactory, a fastener may be inserted through at least one of the securing holes 401 and into the stud 200 during an attachment phase. The fastener inserted into the securing hole 401 may be a nail or a screw such as, for example, a metal dry wall screw, however the fastener is not limited thereto. The size of the securing hole 401 should correspond to the size of the fastener such that the fastener forms a tight fit with the securing hole 401. The combination of the securing holes 401 and the corresponding fasteners maintains the position of the adjustable stud adapter 400 during the attachment phase once plumbness has been measured. For example, utilizing the securing holes 401 may prevent the adjustable stud adapter 100 from moving along a positioning slot 103 when a screw placed through the positioning slot 103 is tightened. The securing holes 401 may be used in conjunction with the positioning slots 103 to attach the adjustable stud adapter 400 during the attachment phase, or in place of the positioning slots 103 to attach the adjustable stud adapter 400 during the attachment phase.

Having described embodiments for an adjustable stud adapter and a method for manufacturing and using the same, it is noted that modifications and variations can be made by persons skilled in the art in light of the above teachings. It is therefore to be understood that changes may be made in exemplary embodiments of the disclosure, which are within the scope and spirit of the disclosure as defined by the appended claims. Having thus described exemplary embodiments of the disclosure with the details and particularity required by the patent laws, what is claimed and desired protected by Letters Patent is set forth in the appended claims.

What is claimed is:

1. A method of leveling a surface, comprising: providing an adjustable stud adapter consisting of a front surface and a side surface extending perpendicular to the front surface, and a single right-angle bend at a portion of the adapter where the front surface meets the side surface, the side surface having a first elongated positioning slot and a second elongated positioning slot;

slidably attaching the adjustable stud adapter to a stud via the first elongated positioning slot and the second elongated positioning slot disposed on the side surface of the adjustable stud adapter by partially driving a first fastener into the stud through the first elongated positioning slot, and partially driving a second fastener into the stud through the second elongated positioning slot, wherein the adjustable stud adapter is substantially aligned with the stud in a lengthwise direction upon attaching the adjustable stud adapter to the stud;

adjusting a plumbness of the front surface of the adjustable stud adapter by slidably adjusting an angle of the adjustable stud adapter relative to the stud, wherein the angle of the adjustable stud adapter is adjusted by sliding edges of the first elongated positioning slot and the second elongated positioning slot on the first fastener and on the second fastener, respectively; and securely attaching the adjustable stud adapter to the stud via the first elongated positioning slot and the second elongated positioning slot by further driving the first fastener into the stud through the first elongated positioning slot, and further driving the second fastener into the stud through the second elongated positioning slot, wherein the front surface of the adjustable stud adapter overlaps a portion of a first side surface of the stud while the adjustable stud adapter is attached to the stud, and the side surface of the adjustable stud adapter overlaps a portion of a second side surface of the stud while the adjustable stud adapter is attached to the stud.

2. The method of claim 1, wherein the first elongated positioning slot is located at a top portion of the adjustable stud adapter, and the second elongated positioning slot is located at a bottom portion of the adjustable stud adapter.

3. A method of leveling a surface, comprising:

providing an adjustable stud adapter consisting of a front surface and a side surface extending perpendicular to the front surface, and a single right-angle bend at a portion of the adapter where the front surface meets the side surface, the side surface having a first elongated positioning slot and a second elongated positioning slot;

inserting a first fastener through the first elongated positioning slot disposed on the side surface of the adjustable stud adapter and inserting a second fastener through the second elongated positioning slot disposed on the side surface of the adjustable stud adapter to slidably attach the adjustable stud adapter to a stud, wherein the adjustable stud adapter is substantially aligned with the stud in a lengthwise direction upon attaching the adjustable stud adapter to the stud, wherein the first and second elongated positioning slots are substantially parallel and spaced from each other;

slidably adjusting a position of the adjustable stud adapter relative to the stud about the first fastener and about the second fastener to adjust a plumbness of the front surface of the adjustable stud adapter; and tightening the first and second fasteners to securely attach the adjustable stud adapter to the stud, wherein the front surface of the adjustable stud adapter overlaps a portion of a first side surface of the stud while the adjustable stud adapter is attached to the stud, and the side surface of the adjustable stud adapter overlaps a portion of a second side surface of the stud while the adjustable stud adapter is attached to the stud.

4. The method of claim 3, wherein the first fastener is inserted through the first elongated positioning slot into the second side surface of the stud, the second fastener is inserted through the second elongated positioning slot into the second side surface of the stud, the second side surface of the stud has an area greater than an area of a top surface of the stud, and the first side surface of the stud has an area greater than the area of the top surface of the stud.

5. The method of claim 4, wherein a space between the front surface of the adjustable stud adapter and the first side surface of the stud is changed upon slidably adjusting the position of the adjustable stud adapter relative to the stud.

6. The method of claim 3, further comprising:

stabilizing the adjustable stud adapter on the stud by driving a third fastener through a first securing hole formed on the side surface of the adjustable stud adapter adjacent to the first elongated positioning slot, and by driving a fourth fastener through a second securing hole formed on the side surface of the adjustable stud adapter adjacent to the second elongated positioning slot, wherein a size of the first securing hole corresponds to a size of the third fastener, and a size of the second securing hole corresponds to a size of the fourth fastener.

7. The method of claim 1, wherein the first fastener is driven into the second side surface of the stud through the first elongated positioning slot, the second fastener is driven into the second side surface of the stud through the second elongated positioning slot, the second side surface of the stud has an area greater than an area of a top surface of the stud, and the first side surface of the stud has an area greater than the area of the top surface of the stud.

8. The method of claim 7, wherein a space between the front surface of the adjustable stud adapter and the first side surface of the stud is changed upon slidably adjusting the angle of the adjustable stud adapter relative to the stud.

9. The method of claim 1, further comprising:

stabilizing the adjustable stud adapter on the stud by driving a third fastener through a first securing hole formed on the side surface of the adjustable stud adapter adjacent to the first elongated positioning slot, and by driving a fourth fastener through a second securing hole formed on the side surface of the adjustable stud adapter adjacent to the second elongated positioning slot, wherein a size of the first securing hole corresponds to a size of the third fastener, and a size of the second securing hole corresponds to a size of the fourth fastener.

* * * * *